United States Patent [19]

Hutchins, Jr.

[11] 4,351,246

[45] Sep. 28, 1982

[54] TEMPORARY DISPLAY STAND FOR MERCHANDIZING

[75] Inventor: Ferris L. Hutchins, Jr., Doraville, Ga.

[73] Assignee: The Mead Corporation, Dayton, Ohio

[21] Appl. No.: 181,261

[22] Filed: Aug. 25, 1980

[51] Int. Cl.[3] ..... A47B 3/06

[52] U.S. Cl. ..... 108/156; 108/111; 211/135; 312/259

[58] Field of Search ..... 108/111, 156; 312/5, 312/259, 260, 261; 211/135; 220/80, 84; 229/23 R, 31 R, 49, DIG. 11

[56] References Cited

U.S. PATENT DOCUMENTS

| | | | |
|---|---|---|---|
| 1,016,259 | 2/1912 | Frey | 220/80 |
| 2,159,069 | 5/1939 | Zalkind | 312/259 |
| 2,805,909 | 9/1957 | Derman | 312/259 |
| 3,372,813 | 3/1968 | Ishida | 211/135 |
| 3,877,396 | 4/1975 | Patterson | 108/111 |
| 4,049,150 | 9/1977 | Goettl | 229/31 R |
| 4,078,690 | 3/1978 | Goettl | 229/31 R |
| 4,102,276 | 7/1978 | Roveroni | 108/156 |
| 4,231,299 | 11/1980 | Gebhardt | 312/259 X |

FOREIGN PATENT DOCUMENTS

| | | | |
|---|---|---|---|
| 659298 | 10/1951 | United Kingdom | 220/84 |

*Primary Examiner*—James T. McCall
*Attorney, Agent, or Firm*—Erwin Doerr

[57] ABSTRACT

A temporary display stand comprising the combination of corner post units and shelf units, all the units being formed from sheet material such as pressed laminated paperboard folded to provide a double ply thickness of material, in which corner portions of each shelf unit are united with respective corner post units by integral connector arms provided by one of the units and secured by retaining sleeves formed by overlapped portions of the other of said units.

7 Claims, 6 Drawing Figures

TEMPORARY DISPLAY STAND FOR MERCHANDIZING

This invention relates to a display stand and in particular to a post and shelf assembly of the stand, in which at least some of the components of the assembly are formed from a stiff foldable material providing a lightweight stand of a temporary nature.

Display shelving assemblies particularly for soft drink merchandising which are formed from a stiff foldable material such as pressed laminated paperboard are known and provide strong stable constructions in relation to the required use. Such assemblies have the advantage that they are relatively cheap, readily assembled and suitable for short term or impermanent usage. Typical examples of the prior art are the U.S. Pats. to Ishida No. 3,372,813; Patterson No. 3,877,396; and Roveroni No. 4,102,276. The present invention not only incorporates these desirable characteristics but also is of simplified construction and supports much heavier loads than known arrangements.

One aspect of the present invention provides a display structure comprising the combination of a corner post unit and a shelf unit having a corner portion connected to said corner post unit, at least one of said units being formed from a foldable sheet material, and wherein the other of said units is provided with connecting means for attachment with cooperating means provided by said one unit, the connecting means comprising projecting arms and the cooperating means comprising a retaining sleeve to receive each of said arms, each retaining sleeve being formed by a portion of said one unit folded to provide a double ply thickness of material.

Another aspect of the invention provides an assembly kit for a display structure which kit includes a corner construction comprising the combination of a corner post unit and a shelf unit, each of said units being formed from a sheet material folded to provide a load bearing structural component of the structure and comprising attachment means for cooperation with the other unit to connect said units together and wherein at least one of said units is folded to form said structural component during attachment to the other unit.

A specific embodiment of the invention, by way of example, is now set forth in the following description taken in conjunction with the accompanying drawings, in which.

Figure 2:
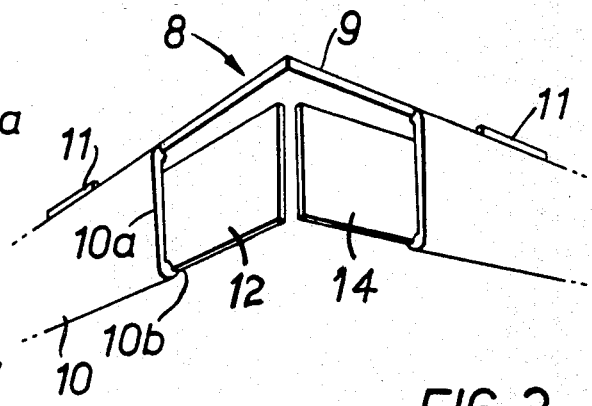
FIG. 2 is a perspective view of a corner portion of a shelf unit.
Figure 2A:
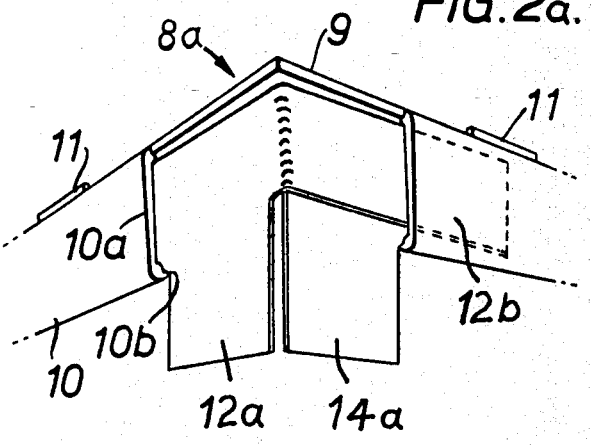
Figure 3:
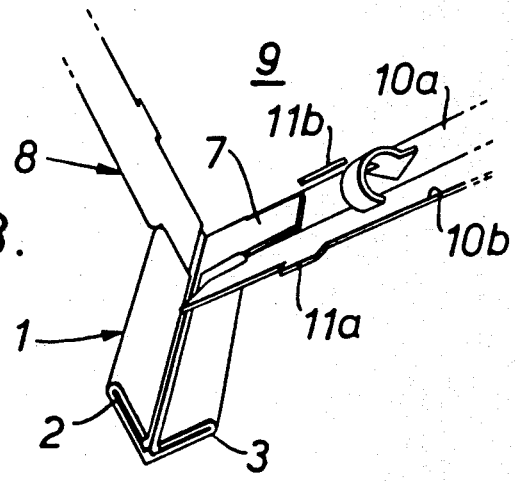
Figure 4:
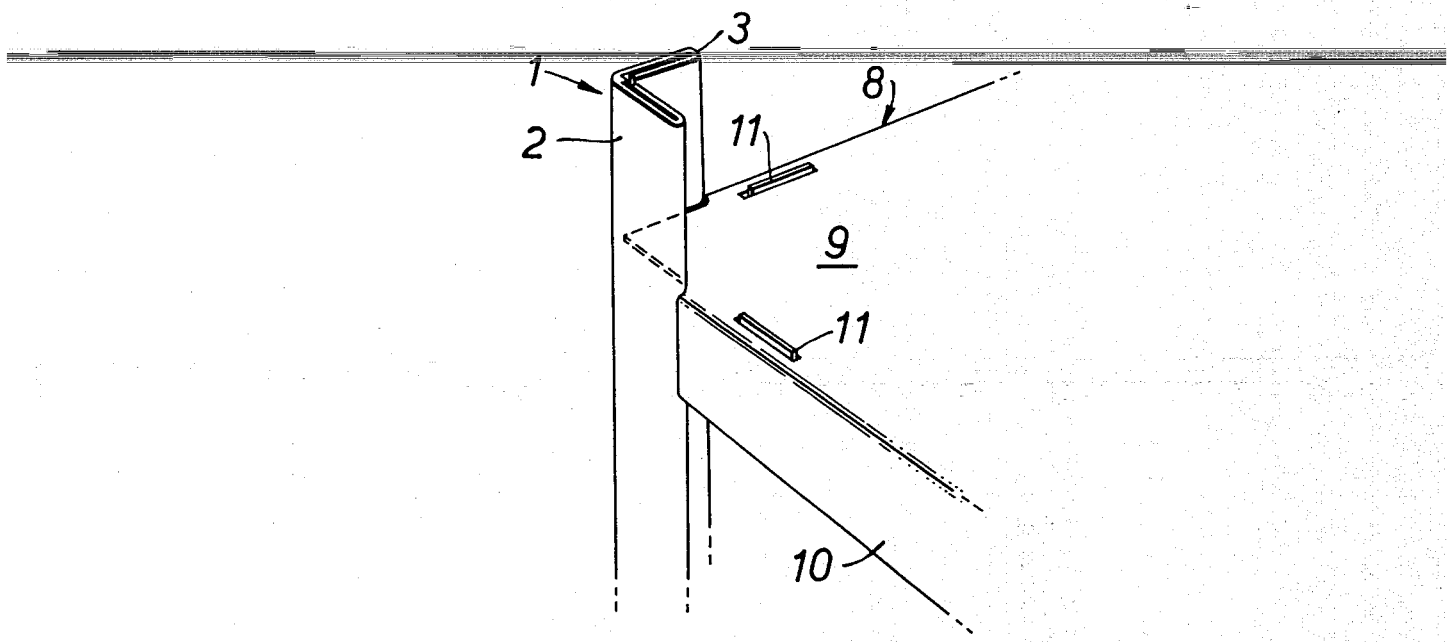
Figure 5:
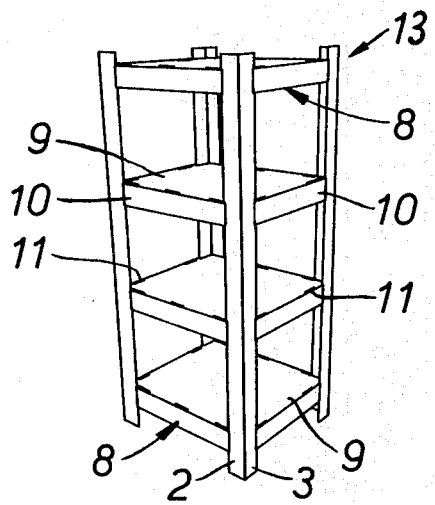

FIG. 2*a* is a perspective view of a modification of the shelf unit illustrated in FIG. 2, FIG. 3 is a perspective view taken from the underside showing the connection of a shelf unit to a corner unit, FIG. 4 is a perspective view taken from above showing an assembled corner construction, and FIG. 5 is a perspective view of a multi-shelf display structure according to the invention.

Figure 1:
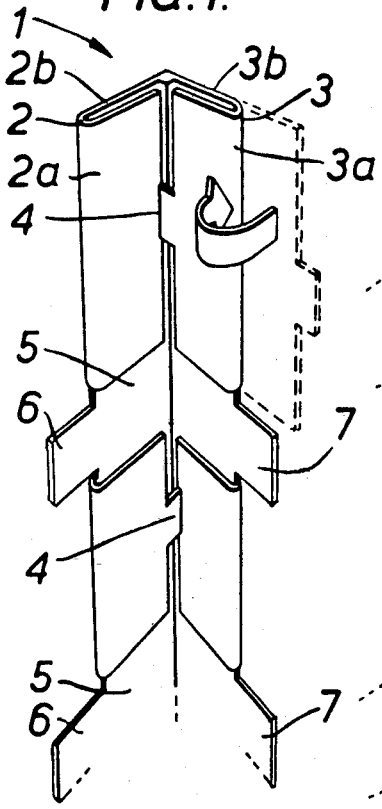
FIG. 1 is a perspective view of a corner post unit.

Referring to the drawings, FIG. 1 shows the inner surfaces of a corner post assembly 1 formed from a relatively stiff but foldable material such as pressed laminated paperboard. The corner post 1 is formed from a single sheet of such material which is folded to provide a pair of integral elongate limbs 2, 3 disposed approximately at right angles to one another thereby forming a corner of an "L" shaped post. The limbs 2, 3 each comprise a double ply thickness of material formed by folding inner limb sections 2*a*, 3*a* inwardly to overlap the inward facing surfaces of outer limb sections 2*b*, 3*b*, respectively as shown in phantom with respect to limb 3.

The inner limb sections are retained in their overlapped relationship by means of mating tab and slot connectors 4 integral with inner limb sections 2*a*, 3*a* and spaced along the abutting longitudinal edges thereof. Preferably, those tabs and slots are alternated along the length of the inner limb sections 2*a*, 3*a* to provide a more secure fastening arrangement.

The inner limb sections 2*a*, 3*a* are each formed with cut out areas longitudinally spaced along the assembly 1 thereby exposing portions of the inner surfaces of outer limb sections 2*b*, 3*b*. Each of the cut out areas is in register with the adjacent cut out area of the other inner limb section thus providing a series of recesses 5 for accommodating the corner portion of a shelf assembly 8 described later in more detail. In order to facilitate connection of the shelf assembly each of the limbs 2, 3 is provided with an integral arm 6, 7, respectively, outstanding from the free longitudinal edge of the limb. Each arm is formed from material removed from the inner limb sections thereby forming the recesses 5.

Referring now to FIGS. 2, 2*a* and 3 of the drawings, there is shown a corner portion of a rectangular shelf assembly 8 formed also from a relatively stiff but foldable material such as pressed laminated paperboard. The shelf assembly 8 is formed from a single sheet of such material and comprises a support surface 9 having an integral peripheral skirt 10 depending therefrom to provide a shelf having an inverted tray like structure. The peripheral skirt 10 is formed from a double ply thickness of material produced by folding inner skirt section 10*b* inwardly and upwardly (see FIG. 3) into overlapping relationship with the inner surface of outer skirt section 10*a*. The skirt sections are retained in their overlapped relationship by a series of mating tab and slot connectors 11 spaced around the assembly 8. The tabs 11*a* are integral with the free edge of inner skirt section 10*b* and spaced therealong. The slots 11*b* are formed in the support surface 9 at locations spaced apart by an amount corresponding to the spacing between adjacent tabs 11*a* (see FIG. 3).

At each corner of the shelf assembly 8 a length of the outer skirt section 10*a* is removed thereby providing a recessed corner portion and exposing a pair of tongues 12 and 14 provided by the inner skirt section 10*b*. In a presently preferred embodiment illustrated in FIG. 2*a*, these tongues 12 and 14 are provided with extensions 12*a* and 14*a* which project downwardly below the skirt of the shelf assembly 8*a*. In addition, tongue 12 may have a horizontal extension 12*b* adapted to be folded around the corner and dimensioned so that its end portion is positioned between the inner and outer skirt sections 10*a* and 10*b* when the shelf unit is assembled.

In order to assemble the shelf assembly 8 and the corner post assembly 1 it is necessary to bring those components together so that they are connected into a unit whilst at the same time forming at least one of the individual assemblies into its completed condition to provide a structural member of the display stand. It will be appreciated that a shelf assembly such as assembly 8 is united with four separate corner post assemblies, one post being provided at each corner of the shelf assembly 8 and moreover it is necessary to effect the various folding operations so that at least two adjacent corner posts are united to a shelf at the same time. However, for the sake of simplicity only one shelf and post corner construction is described, it being understood that the other corner constructions are achieved in a similar manner. Moreover, a plurality of shelf assemblies normally are provided to form a multishelf display structure 13 as shown in FIG. 5.

Each corner post assembly 1 is formed into the structural component as shown in FIG. 1 by folding over and locking together the inner limb sections 2*a*, 3*a*; the shelf assembly 8, on the other hand, will be formed into a structural component while being attached to the corner post assembly. To unite a shelf assembly 8 with each corner post assembly 1 the recessed corner portion of the shelf assembly is mated with abutment with the recess 5 of the corner post assembly such that the pointed corner of support surface 9 is received in the corner of one of recesses 5 with arms 6, 7 lying along the inner faces of adjacent outer skirt sections 10*a*. Thereafter, the inner wall sections 10*b* are folded upwardly and inwardly so that the tongues 12 and 14 are overlapped with the arms 6, 7 and received in the cut out areas of the recess 5. Thus, the arms 6, 7 are received in retaining sleeves provided by the double ply thickness of the skirt sections. To secure the overlapped inner skirt section 10*b* in position the tabs and slots 11 are interconnected as previously described. When all the corners of a shelf assembly 8 have been thus connected, the shelf assembly comprises a structural member of the display unit 13. As shown in FIGS. 2 and 4 the tabs 11*a* protrude through the slots 11*b* in the support surface 9 thereby providing retaining lips to restrain movement of articles placed on the support surface.

In certain other embodiments, however, the shelf assemblies will be pre-formed into completed structural members whereas the corner post assemblies would be completed only at the time when being united with the pre-formed shelf assemblies. A suitable shelf assembly for this purpose is the arrangement shown in FIG. 2*a* and previously described in more detail. It will be understood that the tongue extensions 12*a*, 14*a* will be positioned between the outer and inner limb sections 2*a*, 2*b* and 3*a*, 3*b*, respectively, of the corner post assembly 1. Of course, the arms 6, 7 will be received between the inner and outer skirt sections 10*a* and 10*b*. It is envisaged that the arms 6 and 7 may be omitted in some instances.

It will be appreciated from inspection of FIG. 5 that the display structure 13 is symetrical and, if desired, can be inverted so that the peripheral skirt of each shelf unit extends upwardly thereby allowing the shelf units to be utilized as fixed trays.

It is envisaged that end caps, for example, of a plastics material could be fitted at the extremities of each corner post to provide greater wear resistance and to prevent ingress or absorption of water into the paperboard material. It is further envisaged that either one of the corner post units or the shelf units could be formed from a material other than pressed laminated paperboard or indeed any other foldable material. For example, the corner posts could be formed from a metal or plastics material.

In order to prevent undue deflection of a shelf unit a metal "hat" section (not shown) may be provided which snap-fits beneath the shelf unit within the confines of its peripheral skirt.

What I claim is:

1. A display structure comprising the combination of a corner post unit and a shelf unit having a corner portion connected to said corner post unit, at least one of said units being formed from a foldable sheet material, and wherein the other of said units is provided with connecting means for attachment with cooperating means provided by said one unit, the connecting means comprising projecting arms and the cooperating means comprising a retaining sleeve to receive each of said arms, each retaining sleeve being formed by a portion of said one unit folded to provide a double ply thickness of material, said shelf unit being formed from a foldable sheet material and comprising a support surface and an integral peripheral skirt depending therefrom, said arms being provided on adjacent sides of said corner post unit and being received along the peripheral skirt of said shelf unit, said peripheral skirt having an outer skirt section and an overlapping inner skirt section folded over to provide said retaining sleeve, and a series of mating tabs and slot connector means provided by said shelf unit to retain said inner and outer wall sections in their overlapped relationship, the tabs of said connector means being integrally formed at spaced locations along said inner wall sections and the slots of said connector means being formed at correspondingly spaced locations in said support surface.

2. The display structure according to claim 1 in which the corner post unit is formed from a foldable sheet material, said corner post unit comprising a pair of integral limbs formed to provide an elongate corner construction, and arms projecting from the free longitudinal edge of each of said limbs.

3. The display structure according to claim 2 in which each of said limbs comprises an outer limb section and an inner limb section folded over into overlapping relationship with the inner surface of said outer limb section, and wherein said arms are formed from material removed from said inner limb sections to produce registering cut out areas in said inner limb section thereby providing a recess in said corner post.

4. The display structure according to claim 3 in which a length of said outer skirt section is removed along adjacent sections of said corner portion of the shelf unit thereby forming a recess in the peripheral skirt at said corner portion and exposing a pair of tongues provided by said inner skirt section, and wherein the corner recess of said shelf unit is mated with the recess in said corner post with said arms lying along the inner surface of said outer skirt section and being overlapped by the respective ones of said tongues.

5. The display structure according to claim 4, in which said tongues are provided with downwardly projecting extensions arranged to be positioned between said outer and inner limb sections.

6. The display structure according to claim 3 or claim 4 further comprising a series of mating tab and slot connector means provided at spaced locations along abutting longitudinal edges of said inner limb sections, said tabs and slots being alternatively formed along each of said inner limb sections.

7. The display structure according to claim 1 in which the structure comprises four corner post units and a plurality of spaced parallel shelf units united to each of said corner post units by means of said arms and said retaining sleeves.

* * * * *